US008411881B2

(12) United States Patent
Shun Shiu et al.

(10) Patent No.: US 8,411,881 B2
(45) Date of Patent: Apr. 2, 2013

(54) ELECTRET CAPACITOR MICROPHONE WITH ONE-PIECE VOCAL CAVITY COMPONENT

(75) Inventors: Ho Shun Shiu, Zhejiang (CN); Zhiqing Hu, Zhejiang (CN); Jianyong Wu, Zhejiang (CN); Xiaowen Chen, Zhejiang (CN)

(73) Assignee: Well Inland Multimedia Manufacture (Ningbo) Co., Ltd., Fenghua District Ningbo, Zhejiang (CN)

( * ) Notice: Subject to any disclaimer, the term of this patent is extended or adjusted under 35 U.S.C. 154(b) by 199 days.

(21) Appl. No.: 12/989,259

(22) PCT Filed: Apr. 21, 2009

(86) PCT No.: PCT/CN2009/071392

§ 371 (c)(1), (2), (4) Date: Oct. 22, 2010

(87) PCT Pub. No.: WO2009/129738

PCT Pub. Date: Oct. 29, 2009

(65) Prior Publication Data

US 2011/0038502 A1 Feb. 17, 2011

(30) Foreign Application Priority Data

Apr. 22, 2008 (CN) ..... 2008 1 0060671

(51) Int. Cl.
*H04R 25/00* (2006.01)
*H04R 11/04* (2006.01)

(52) U.S. Cl. ..... 381/174; 381/369

(58) Field of Classification Search ..... 381/174, 381/176, 355, 369

See application file for complete search history.

(56) References Cited

U.S. PATENT DOCUMENTS 7,620,191 B2 * 11/2009 Tanabe et al. ..... 381/174
2005/0025328 A1 * 2/2005 Song ..... 381/369

FOREIGN PATENT DOCUMENTS

WO PCT/CN2009/071392 10/2010

* cited by examiner

*Primary Examiner* — Brian Ensey
(74) *Attorney, Agent, or Firm* — Global IP Services; Tianhua Gu

(57) ABSTRACT

An electret capacitor microphone with one-piece vocal cavity component includes: a shell, a vibration element and a circuit board which is used to envelop the shell containing cavity and connect with the shell; the first vocal cavity is formed between the vibration element and the inner surface of the top of the shell; voice holes are connected with the first vocal cavity; wherein, one-piece vocal component that lies between the vibration element and circuit board is installed in the shell. The one-piece vocal cavity component is formed by an annular sidewall and a cavity board formed in one-piece on the annular sidewall. A through-hole is formed on the cavity board and inner concave at lower end of an annular sidewall. The second vocal cavity is formed between the annular sidewall and the cavity board. An external surface of the annular sidewall is coated with an insulating material layer.

5 Claims, 5 Drawing Sheets

ELECTRET CAPACITOR MICROPHONE WITH ONE-PIECE VOCAL CAVITY COMPONENT

CROSS REFERENCE TO RELATED PATENT APPLICATION

The present application is the US national stage of PCT/CN2009/071392 filed on Apr. 21, 2009, which claims the priority of the Chinese patent application No. 200810060671.1 filed on Apr. 22, 2008, which application is incorporated herein by reference.

FIELD OF THE INVENTION

This invention is relating to a microphone, which is featured by including an one-piece vocal cavity component, its filed belongs to vocal equipments.

BACKGROUND OF THE INVENTION

Over years, microphones transforming sound wave to electrical signal are more and more used to communication industry (for example, telephone, mobile), multi-media computer system (VoIP), electronic toy (for example electronic game console, sound-controlled toy) and stereo equipment (for example DC, DV, MP3, MP4, hands-free audio frequency components) and other kind of products. The electret capacitance microphone (EMC) is widely applied in these industry. It usually includes: a metal shell surrounded by top surface and side wall with many hole-like sound channel on the top of the shell; a vibrating board inside the shell including a metal ring and a vibrating diaphragm on the ring-like head face; a back polar board; a plastic ring which is installed between the back polar board and metal ring, form a certain distance between the back polar board and vibrating diaphragm; a copper frame which is installed under the back polar board, connecting between the back polar board and the copper connect of circuit of technotron (JFET). In order to avoid the back polar board and copper frame being connected to the shell electricity, usually a plastic ring-like frame is installed outside of them for the insulation.

When the electret capacitance microphone is working, the sound wave enters into the shell through the hole-like channels to make vibration of the vibrating diaphragm. and the flat capacitance is formed by the vibrating diaphragm and the back polar board, thereby the vibration make the flat capacitance change too. Because, there is electret material on the vibrating diaphragm and back polar board, one of them is charged and the electret material on the one holds the electric charge too, thus there is stable quantity of electric charge in the capacitance. Therefore, the voltage between the two ends of the capacitance is changed by the distance changing between the positive and negative polar plates, so the formed acoustoelectric effect makes feeble electric signals, and then the electric signals go to a circuit board through a copper frame, and are transformed as required electrical signals by the circuit board.

When installation, put vibrating board inside the shell firstly, secondly put the plastic ring, then put the back polar board, copper frame and plastic frame in proper sequence, finally put the circuit board to seal the entrance and install the dust-proof clothing on the shell. It can be seen from the assembly, the total components are not less than 8 pieces, at least eight different procedures are needed, the cumulative error from each component will be big enough. Therefore, the manufacture accuracy is highly required, the assembling is difficult, that directly affect the product percent of pass, consistency of finished products, material cost and labor cost. Furthermore, the manufacture and assembling procedure is long, components are exposed in air for long time and many hand-operations, these disadvantages make components stick dust easily, these are serious affecting the sensitivity of product and the rate of product pass.

SUMMARY OF THE INVENTION

The technology problem and technology task of this invention is to overcome existing technology shortcomings, offer a kind of electret microphone with one-piece vocal cavity. The electret microphone must be less components, smaller cumulative error, simple assembling procedures, convenient assembling, low manufacture cost, high rate of product pass and stable quality. Therefore, the creative idea in this invention as followings:

A electret microphone comprises a shell having cavity and tune holes being on a top surface of the shell, a vibration element is located in the shell, a circuit board is used to connect with the shell, a first vocal cavity is formed between said vibration element and inner top surface of the shell; said voice hole is through to the first vocal cavity; an one-piece vocal cavity component is located between the vibration element and the circuit board comprising a ring-like side wall and a cavity board integrated with the side wall, there is a through hole on the cavity board which is sunken in the side wall, the side wall, cavity board and vibration element define a second vocal cavity; outside of the side wall is coated by an insulation-material layer. The one-piece vocal cavity component with a special structure omits the back polar board, copper frame and plastic frame and other components that are included in traditional electret capacitance; the cavity board, side wall and insulation material layer are equivalent to back polar board, copper frame and plastic frame, one component but has multi-function of connecting with capacitance polar board, circuit board electricity and isolated from shell, the quantity of components is reduced, the whole structure and production procedure are simplified, the assembling relation of necessary components is improved, and the cumulative error of components is reduced effectively; it is also convenient to assembling, shorten the assembling time, thereby the exposed time in air and hand-operated time is shortened, thus guarantee the components' sensitivity, and improve the product quality, rate of product pass, and reduce manufacture cost. There is no limitation for the shape of side wall, it can be round, square, triangle or oval etc, also it can be sealed ring or saw-tooth and any other shape. The insulation material on the surfaces of the side wall and shell should be satisfied the insulation equipments. All other surface of side wall of one-piece vocal cavity component except side wall can be coated with insulation material or without insulation material. If coated with insulation material, which can be electret material having certain quantity of electrical charge in advance.

Furthermore, following technical features can be added:

Said one-piece vocal cavity component is made of conducting materials. And this materials must meet the requirement of forming a polar board at one end of the capacitance.

The microphone also contains a insulation ring which is between the vibration element and the one-piece vocal cavity component. When the roof of one-piece vocal cavity is flat, the insulation ring will apart the vibration element from the one-piece vocal cavity component a certain distance to form a plate capacitor, and to provide the vibration element a space for generating vibration to form electrical signal to form the sound wave vibration.

Said capacitor chamber is defined by the side wall and the inner cavity board, thereby, the one-piece vocal cavity constructional component comprises a capacitor chamber at upper side and a second vocal cavity at lower side, there is a protruded shoulder formed on the upper surface of the cavity board, its side face and top surface are coated with insulation-material layer. a bulge part is set on the one-piece vocal cavity component for separating vibration element from one-piece vocal cavity component, so that a plate capacitor can be formed and the plastic ring used in traditional structures can be replaced. The purposes for further optimizing the structure of product, reducing component quantity of product and improving assembling efficiency are achieved. The inner side face of the bulge part can be coated with insulating material layer, or not.

An input terminal is set on the circuit board, a bottom face of the side wall is connected electrically to the input terminal. The one-piece vocal cavity component transmit the electrical signals of sound wave to the circuit board through the bottom face of the side wall, and the treatment and output will be proceed by whose electrical parts, usually the input terminal can be copper pouring part of circuit board.

Said vibration element comprises a vibrating diaphragm and a ring-like part, said vibrating diaphragm is made of insulation material, upper surface of the vibrating diaphragm is coated with a metal-material layer, the ring-like part is set on top of the metal-material layer, the ring-like part is connected with the shell, a back surface of the vibrating diaphragm is connected to protruded shoulder. Insulating material can be regarded as electret material which can maintain and restrict certain quantity of electrical charge. When the vibrating diaphragm is vibrating, as the ring part makes the inner surface of shell roof apart from the vibrating diaphragm, so that a space is made between them for vibrating of the vibrating diaphragm, also the electrical connection can be made between metal material layer of vibrating diaphragm and shell.

The new one-piece vocal cavity component replaces the back polar board, copper frame and plastic frame and other components used in traditional electret capacitance, meanwhile multi-function for one component is realized, the procedure of assembling is improved, the quantity of components is reduced, the structure, assembling relation and production procedure are optimized, and the cumulate errors from components is reduced too; it is also convenient to assembling, shorten the assembling time, that is, the exposed time in air and hand-operated time is shortened, thus guarantee components' sensitivity, and improve product quality, rate of qualified product, and reduce production cost.

In Figs.: 1 dust-proof clothing, 2 aluminum detonator, 3 vibrating plate 4 plastic ring, 5 back polar plate, 6 copper frame, 7 plastic frame, 8 circuit board, 100 electret capacitance microphone with one-piece vocal cavity component, 101 dust-proof clothing, 110 shell, 111 voice hole, 112 inner surface of roof, 113 outside surface of roof, 114 connecting surface of shell, 120 vibration elements, 121 upper surface of vibrating diaphragm, 122 low surface of vibrating diaphragm, 123 ring components, 130 insulation ring, 140 one-piece vocal cavity component, 141 pylome, 142 upper surface of cavity board, 143 inner surface, 144 embossing part, 145 side wall, 146 capacitor chamber, 147 second vocal cavity, 150 circuit board, 151 upper surface of circuit, 152 input terminal, 153 outside surface of circuit board.

DETAIL DESCRIPTION OF THE INVENTION

Refer to the figures the embodiments of present invention are described in detail.

Figure 1:
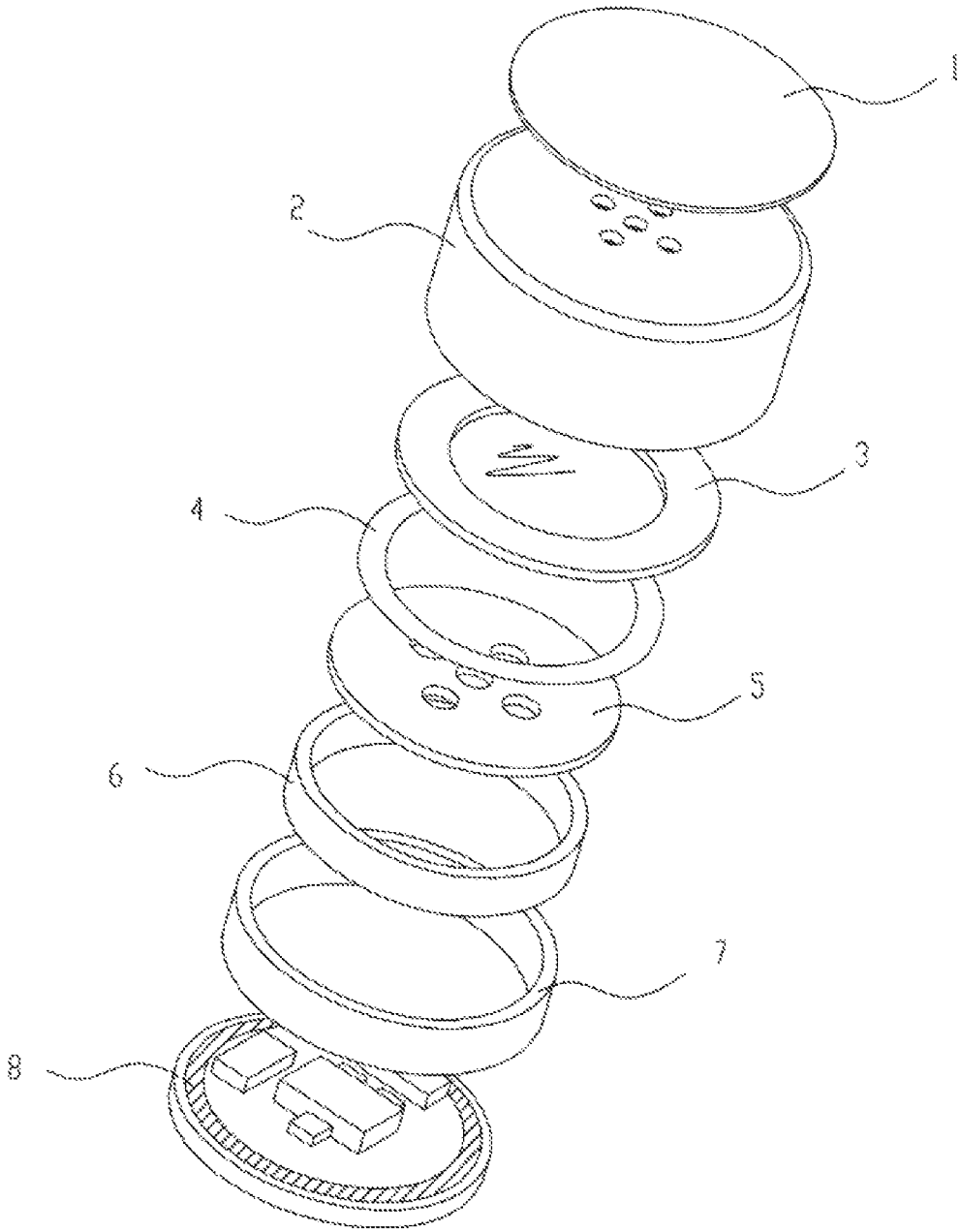
Fig 1 PRIOR ART
FIG. 1 pictorial assembling structure drawing for current technology.
Figure 2:
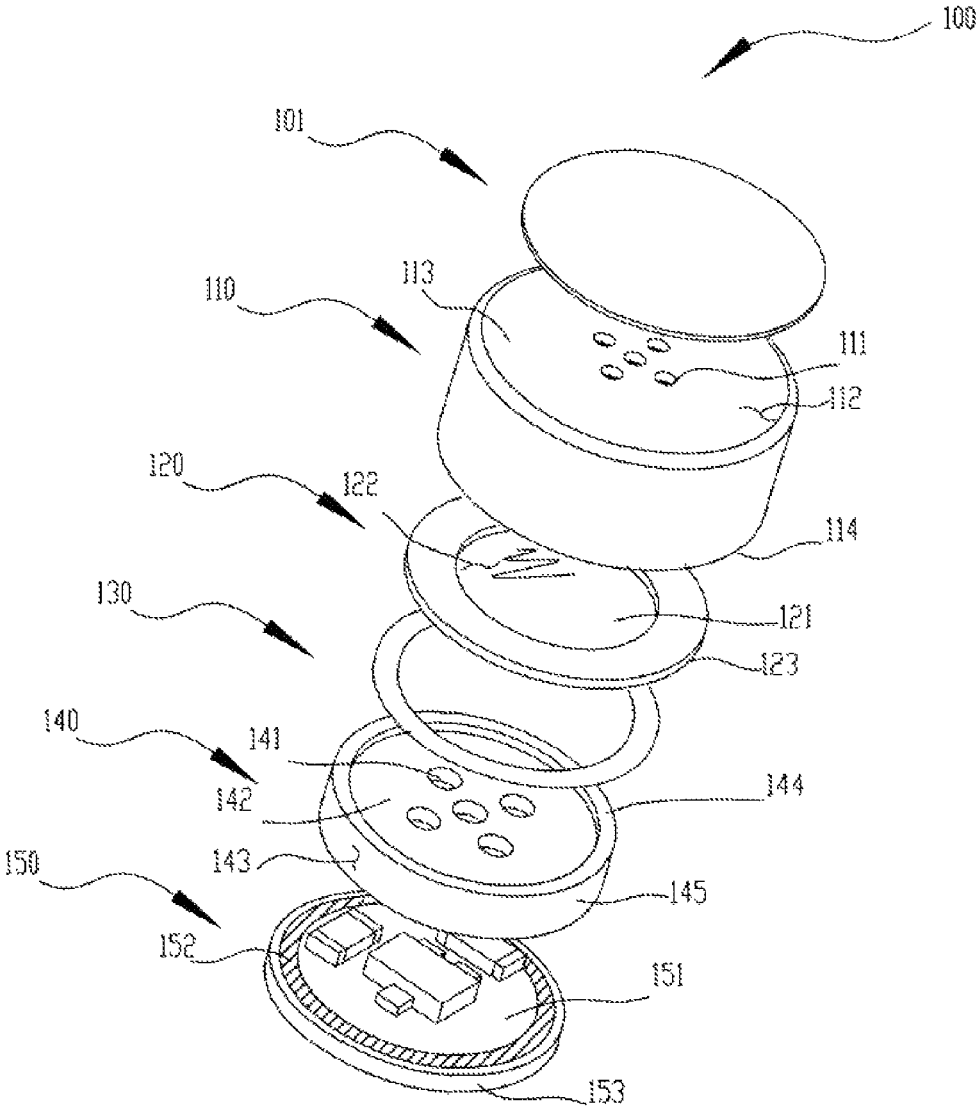
FIG. 2 pictorial assembling structure drawing for example 1 of the invention.
Figure 3:
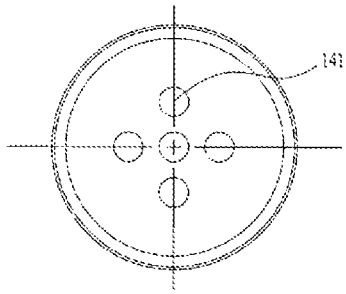
FIG. 3 planar drawing for the vocal cavity component of example 1 of the invention.
Figure 4:
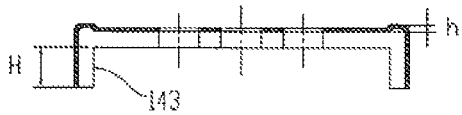
FIG. 4 cross section drawing for the vocal cavity component of example 1 of the invention.
Figure 5:
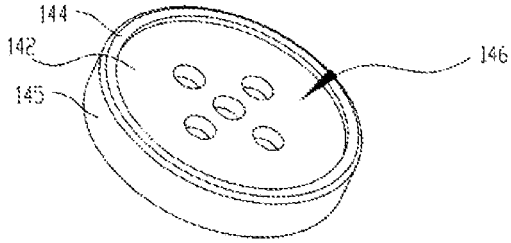
FIG. 5 perspective drawing for vocal cavity component of example 1 of the invention.
Figure 6:
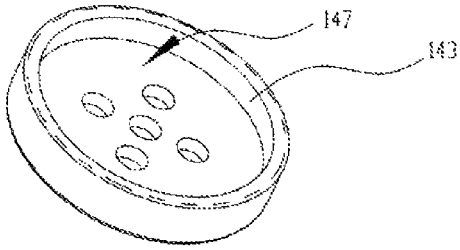
FIG. 6 reverse perspective drawing for vocal cavity component of example 1 of the invention.

Refer to the FIG. 1, an electret capacitance microphone with current technology, includes a dust-proof clothing 1. A cavity is surrounded by roof and side wall, the cavity likes an inverted bowl-shaped aluminum shell 2, there are many hole-like channels on the roof of the aluminum shell 2, allowing the sound enters into the cavity. A vibrating board 3, which is set inside the aluminum shell 2 and touching with inner side wall of the aluminum shell, includes a metal ring and a vibrating diaphragm which is set on the ring-like bottom face of the metal ring. A back polar board 5. A plastic ring 4, which is set between the back polar board 5 and metal ring, the plastic ring makes certain space for the back polar board and vibrating board. A copper frame 7, which is set under the back polar board 5, making connection for the back polar board 5 and an input terminal electricity of the circuit board 8 of a junction type field effect transistor (JFET). In order to avoid electric connection between the back polar board 5, copper frame 7 and aluminum shell 2, usually a plastic ring frame 6 is used outside to insulate between them.

As showed from FIGS. 2-6, an electret capacitance microphone 100 with one-piece vocal cavity component comprises a metal material made cavity shell 110 with sound aperture 111, the cavity is surrounded by roof and shell wall; a dust-proof clothing 101 applied on the outside surface of shell 110; a vibration element 120 is set inner the shell; a vibration element 120 includes a vibrating diaphragm and a ring components 123 which is made of metal materials, the vibrating diaphragm is made of insulating material; a metal material layer on the upper surface 121 of vibrating diaphragm; a ring components 123 is set on the metal material layer to isolate the vibrating diaphragm and bottom surface of inner shell, it is easy for the vibrating diaphragm to vibrate; an electric connection between the ring component 123 and shell 110 can be made through welding, cementation or other methods; in case some sundries and dust enter into the inside during the assembling, it will affect sensitivity; circuit board 150 which is used to seal the cavity of shell 110 is connected electrically with surrounding of the shell 110; the first vocal cavity is formed between the vibration element 120 and the inner surface 112 of shell 110 roof; the voice hole 111 is through to the first vocal cavity; inside the shell 110 there are a one-piece vocal cavity component 140 between the vibration element 120 and circuit board 150 made of conducting material layer; the one-piece vocal cavity component 140 includes a side wall 145 and a cavity plate, a second vocal cavity defined by the low side wall and the cavity plate (drawing 4, the part showing H), there are through-holes 141 on the cavity plate, the side wall 145 is coated with insulating material layer, the side wall 145 is formed to be cavity plate surroundings, also can be formed as inner side of surroundings, the surroundings can be constant ring-like shape or non-constant bulge shape, the position of the surroundings is corresponding to the input terminal 152 of the circuit board 150.

The side wall above the upper surface 142 of the cavity plate forms a bulge part 144, there is insulating layer on the outside side face and top surface of the bulge part 144. bottom surface 122 of the vibrating diaphragm is connected to the bulge part 144. in order to enlarge the space between the vibrating diaphragm and the one-piece vocal cavity component (FIG. 4, the part shown as H) a plastic insulation ring 130 can be inserted, when the h is s 0, it means the upper surface of the cavity plate 142 is flat and no bulge part 144 is existed, then a insulation ring 130 must be inserted to guarantee the plate capacity is formed.

electrical components are set on the circuit board 150, the input terminal 152 has a ring-like copper layer, the bottom of side wall 145 is connected electrically to the input terminal 152 (touching connection, welding or any other fixed connecting methods), the outside surface 153 of the circuit board is connected electrically to the shell 110.

When assembling, install the vibration elements 120, one-piece vocal cavity component 140 into the cavity of shell 110 one by one, then put the upper surface 151 of circuit board 150 on and contact to the one-piece vocal cavity component and seal them at the entrance of the shell 110, finally fasten them with the help of the machine or welding to keep contacting between the edges of circuit board 150 and shell 110.

Figure 7:
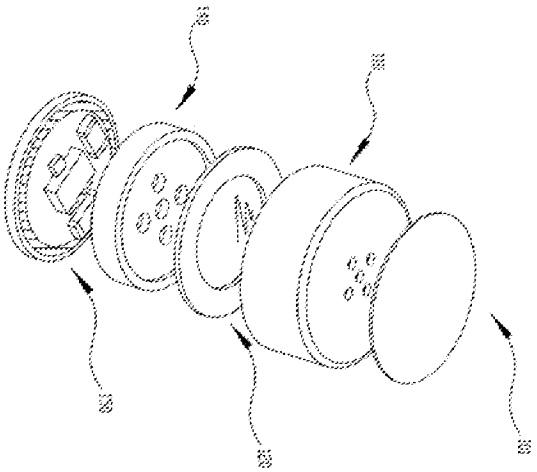
FIG. 7 pictorial assembling structure drawing for example 2 of the invention.

As showed in the FIG. 7, in the example 2 on the upper surface 142 of the cavity plate set a bulge part 144 covered by a insulating-material layer, the insulating material layer can be coated on the roof and outside side face of the bulge part 144, and no restriction for its rest parts. In this way the insulation ring between the vibration element and one-piece vocal cavity component is unneeded, other sections are the same as example 1.

Figure 8:
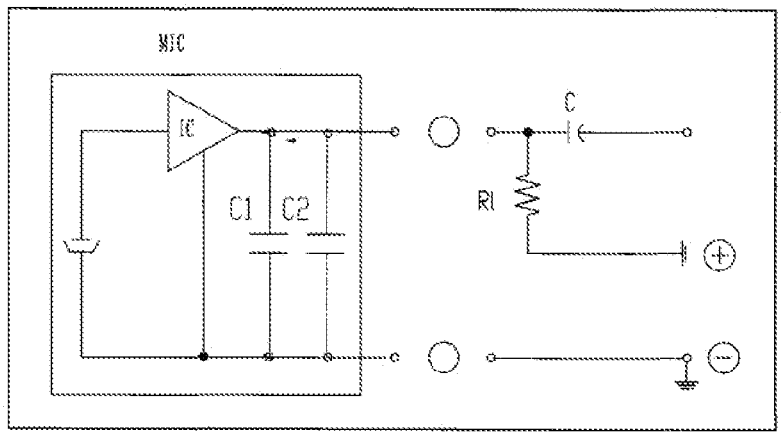
FIG. 8 circuit diagram of circuit board of the invention.

As shown in FIG. 8, the bottom of one-piece vocal cavity 140 and side wall 145 are contacted with the input terminal 152 with copper ring shape of the circuit board. electric signals are transmitted to the circuit board 150 to take signal treatment, and output audio signals. Also the electric signals can be transmitted to the modulus transformer on the circuit board 150 and then output audio signals.

Figure 9:
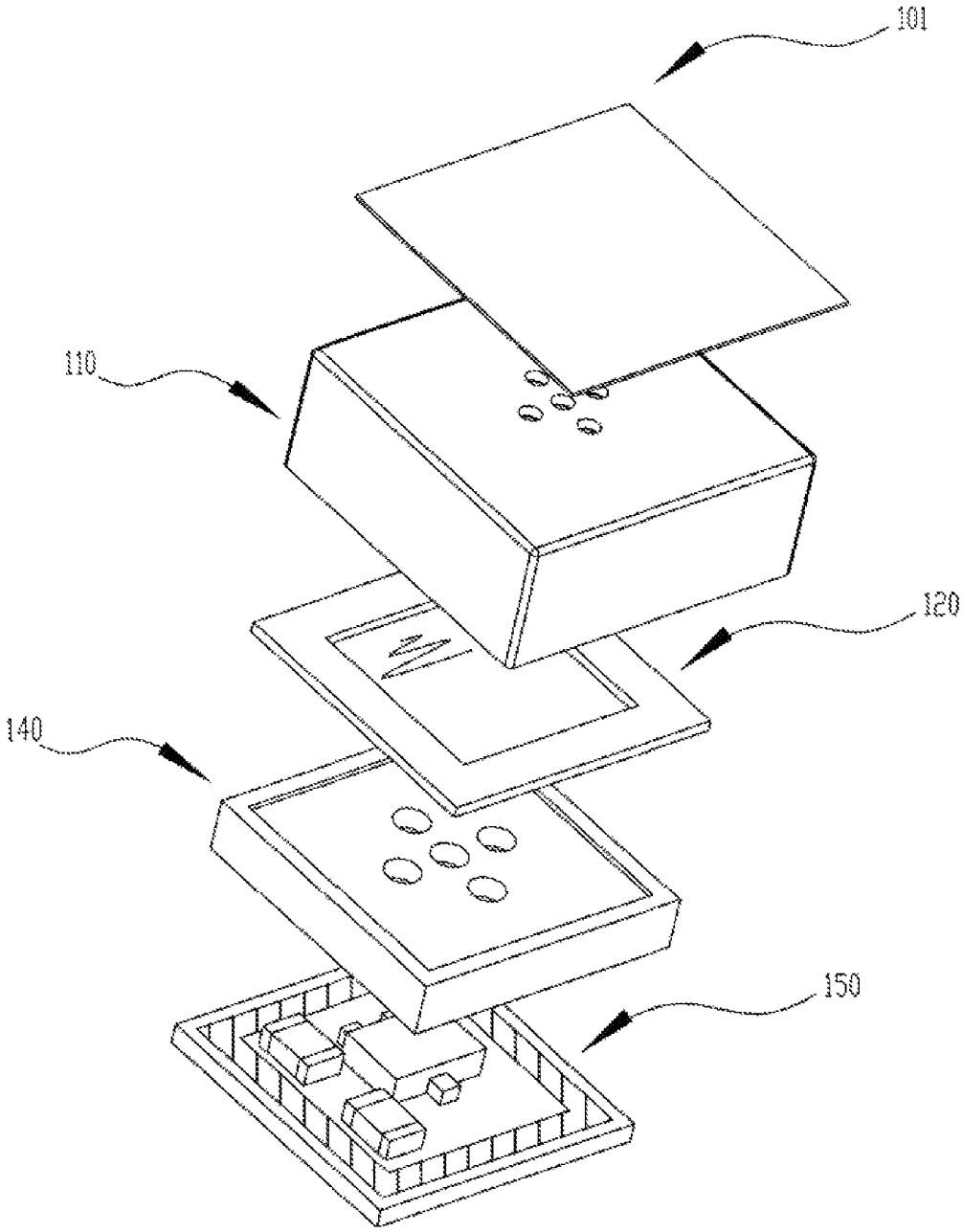
FIG. 9 pictorial assembling structure drawing for example 3 of the invention.

As shown in FIG. 9, the components in the example 3 are changed to be square shape based on the example 2.

The detail descriptions of the examples is for better understanding the present invention, any further change made for the invention will fall in the scope of the invention.

What is claimed is:

1. An electret capacitor microphone with one-piece vocal cavity component comprising:

a shell (110) having cavity and a tune hole (111) being on a top surface of the shell, a vibration element (120) located in the shell, a circuit board (150) used to connect with the shell;

a first vocal cavity is formed between said vibration element (120) and inner top surface (112) of the shell (110);

said voice hole (111) is through to the first vocal cavity;

an one-piece vocal cavity component (140) made of conducting materials located between the vibration element (120) and the circuit board (150) comprising a ring-like side wall (145) and a cavity board integrated with the side wall, there is a through hole (141) on the cavity board which is sunken in the side wall, the side wall (145), cavity board and vibration element define a second vocal cavity;

outside of the side wall (145) is coated by insulation-material layer.

2. The electret capacitor microphone with one-piece vocal cavity component of claim 1, wherein a insulation ring (130) is located between the vibration element (120) and the one-piece vocal cavity component (140).

3. The electret capacitor microphone with one-piece vocal cavity component of claim 1, wherein a capacitor chamber (146) formed on top of the side wall (145) is sunken in the inner cavity board, thereby, the one-piece vocal cavity constructional components comprises the capacitor chamber (146) at upper side and a second vocal cavity (147) at lower side, there is a protruded shoulder (144) formed on the upper side of cavity board surface (142), its side face and top surface are coated with insulation-material layer.

4. The electret capacitor microphone with one-piece vocal cavity component of claim 3, wherein an input terminal (152) is set on the circuit board (150), a bottom of the side wall (145) is connected to the input terminal (152) electrically.

5. The electret capacitor microphone with one-piece vocal cavity component of claim 4, wherein the vibration element (120) comprises a vibrating diaphragm and a ring-like part (123), said vibrating diaphragm is made of insulation material, upper surface of the vibrating diaphragm (121) is coated with a metal-material layer, the ring like part (123) is set on top of the metal-material layer, the ring-like part (123) is connected with the shell (110), a back surface (122) of the vibrating diaphragm is connected to protruded shoulder (144).

* * * * *